US006364577B1

(12) United States Patent
Haney

(10) Patent No.: US 6,364,577 B1
(45) Date of Patent: Apr. 2, 2002

(54) PILE DRIVING TRANSITION PIECE

(75) Inventor: James Allan Haney, Houston, TX (US)

(73) Assignee: J. Ray McDermott, S.A., Houston, TX (US)

( * ) Notice: Subject to any disclaimer, the term of this patent is extended or adjusted under 35 U.S.C. 154(b) by 0 days.

(21) Appl. No.: 09/576,365

(22) Filed: May 22, 2000

(51) Int. Cl.[7] ..... E02D 7/00
(52) U.S. Cl. ..... 405/228; 173/131
(58) Field of Search ..... 405/224, 227, 405/251, 211, 223.1, 228, 224.1–224.4; 173/131, 132, 139, 137, 211, 212, 20, 232

(56) References Cited

U.S. PATENT DOCUMENTS 3,991,833 A * 11/1976 Ruppert ..... 173/20
4,102,143 A * 7/1978 Phares et al. ..... 405/224
4,318,446 A * 3/1982 Livesay ..... 173/13
4,366,870 A * 1/1983 Frederick ..... 173/131
4,408,668 A * 10/1983 Kuhn et al. ..... 173/139
4,457,499 A * 7/1984 Townsend ..... 267/137
4,465,145 A * 8/1984 Kuhn ..... 173/131

* cited by examiner

*Primary Examiner*—Robert E. Pezzuto
(74) *Attorney, Agent, or Firm*—D. Neil LaHave; Rob Baraona; Eric Marich

(57) ABSTRACT

A pile driving transition piece. The transition piece avoids the shock loading in the stabbing points of pile driving transition pieces that otherwise would be induced when the pile driving hammer strikes the transition piece. Avoiding the shock loading prevents the characteristic fatigue cracks from forming in the stabbing point and the consequent failure of the stabbing points from rapid growth of the fatigue cracks.

8 Claims, 5 Drawing Sheets

PILE DRIVING TRANSITION PIECE

BACKGROUND OF THE INVENTION

1. Field of the Invention

The invention is generally related to pile driving and more particularly to the design of pile driving transition pieces.

2. General Background

Pile driving hammers, particularly hydraulic hammers designed to drive pipe piles in the offshore environment, are of two types. One type has an external sleeve that enables the hammer to be cantilevered from the top of the pile that is being driven, sometimes known as a free riding hammer. The other type has a constant diameter that is equal to the diameter of the pile that is being driven, sometimes known as a slimline hammer. The free riding and slimline hammers are represented in FIGS. 1 and 3, respectively. The slimline hammer cannot cantilever from the pile top and must be supported by guides. The external guide and stabbing bell of the free riding hammer cannot clear support guides, so the pile must cantilever the free riding hammer above any obstructions.

A free riding hammer can be used to drive a battered pile. A couple at the level of the pile driving head and the bottom of the external sleeve of the hammer develops the necessary cantilever moment. The arrows in FIG. 1 represent the couple. Frequently, in pile driving operations a pile is driven to partial penetration with a smaller hammer and driven to final penetration with a larger hammer. Often, the external sleeve of the smaller hammer will not fit over the pile, which fits the larger hammer. To solve this problem a pile driving transition piece is stabbed into the pile top and the smaller hammer is stabbed over the smaller top end of the transition piece, as shown in FIG. 2. The hammer cantilevers from the transition piece, developing the couple C1 represented by the arrows acting on the top end in FIG. 2. The transition piece cantilevers from the pile top, developing the couple C2 represented by the arrows acting on the transition piece stabbing point 23. A greater pile batter will develop a greater couple acting on the stabbing point. Making the stabbing point longer reduces the magnitude of the couple.

Historically, transition piece stabbing points have had a fatigue problem, which gets worse as the stabbing points are made longer. A fatigue crack 24 forms a few inches below the driving shoulder and runs circumferentially around the stabbing point, causing the stabbing point to break off and fall into the interior of the pile. If the pile is battered enough, the transition piece and hammer will fall off the top of the pile once the stabbing point breaks off. The typical location for the fatigue crack 24 is indicated in FIG. 2.

A slimline hammer, as seen in FIG. 3, can only fit one diameter of pile. To use a slimline hammer on a pile with a diameter greater than the hammer diameter presents a support problem because the support guides must be sized for the larger diameter pile. Then the guides are too large to support the smaller diameter hammer.

SUMMARY OF THE INVENTION

The invention addresses the above needs of preventing fatigue cracks and allowing a slimline hammer to be used on more than one pile diameter. What is provided is a shock avoiding pile driving transition piece. The transition piece separates the function of delivering the driving energy of the hammer to the pile top from the function of cantilevering the hammer and transition piece from the top of the pile. A shock isolation unit provides the only axial connection between the transition cantilever element and the driving element. The connection is made with an elastomeric material. The material is resilient, so that when a blow is struck on top of the driving element, the driving energy passes through the driving element to the pile top without a significant portion of the energy being diverted into the cantilever element.

BRIEF DESCRIPTION OF THE DRAWINGS

For a further understanding of the nature and objects of the present invention reference should be made to the following description, taken in conjunction with the accompanying drawing in which like parts are given like reference numerals, and wherein.

DETAILED DESCRIPTION OF THE PREFERRED EMBODIMENT

Figure 1:
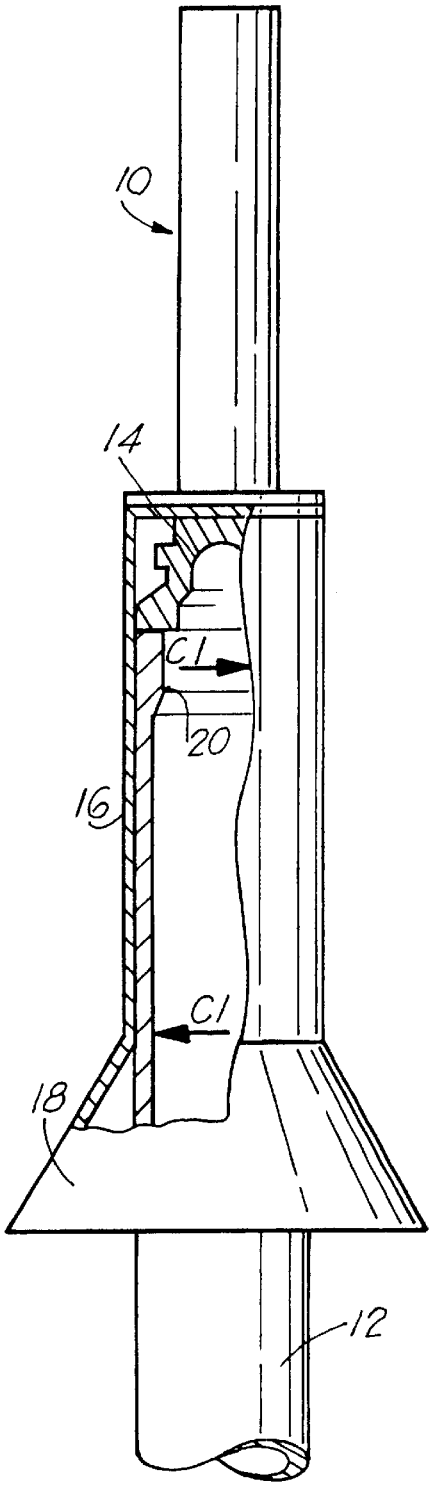
FIG. 1 PRIOR ART
FIG. 1 illustrates a prior art free riding hammer and transition piece.

FIG. 1 illustrates a prior art arrangement for a free riding hammer 10 resting on a pile 12. Among other components, a free riding hammer 10 is generally formed from a hammer anvil 14 and an external sleeve 16. The sleeve 16 has an internal diameter that is slightly larger than the outer diameter of the pile 12. A stabbing bell 18 is provided on the lower end of the sleeve 16 to provide for easier positioning of the sleeve over the pile. The upper end of the pile 12 is provided with an increased wall thickness driving head 20, which the hammer anvil 14 strikes. As indicated above, a free riding hammer can be used to drive a battered pile (a pile that is at an angle from the vertical). A couple C1, acting on the sleeve 16 at the level of the driving head 20 and the level at the bottom of the sleeve 16, develops the necessary cantilever moment.

Figure 2:
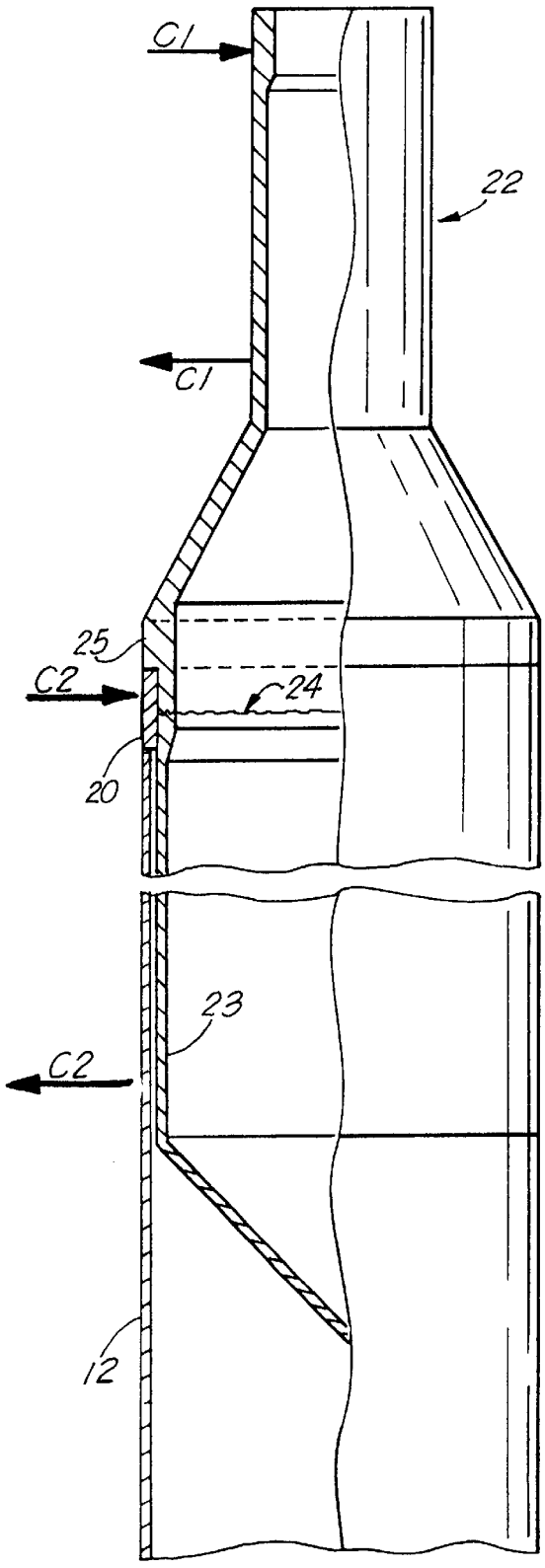
FIG. 2 PRIOR ART
FIG. 2 illustrates the prior art where a transition piece is used to accommodate a hammer smaller than the pile, and a typical fatigue crack.

FIG. 2 illustrates a prior art arrangement for a free riding hammer 10 where the size of the free riding hammer 10 and pile. 12 do not match. It should be noted that the free riding hammer 10 is not shown in this drawing. To accommodate the size difference, a transition piece 22 is stabbed into the top of the pile 12 and the free riding hammer 10 is stabbed over the smaller top end of the transition piece 22. As described above, the upper end of the pile 12 is provided with an increased wall thickness driving head 20 that the hammer anvil 14 strikes. A fatigue crack 24 that is characteristic of this arrangement is indicated in the location that the crack normally develops, i.e., shortly below the driving shoulder of the transition piece.

The couple C1 cantilevers the free riding hammer 10 from the transition piece 22. The couple C2 cantilevers the transition piece 22 from the pile 12.

Figure 3:
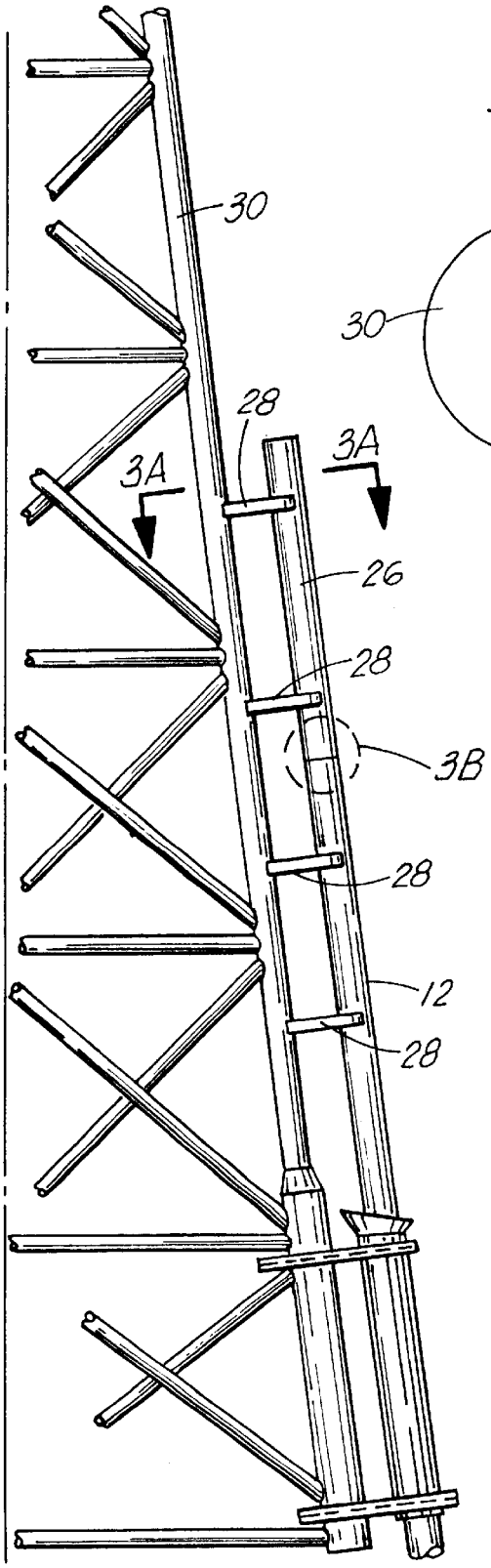
FIG. 3 PRIOR ART
FIG. 3 illustrates a prior art slimline hammer driving a battered pile.
Figure 3A:
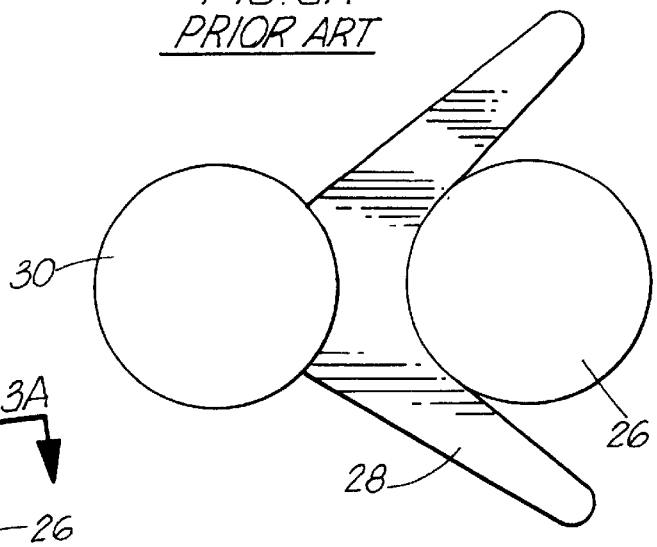
FIG. 3A PRIOR ART
FIG. 3A is a view taken along lines 3A—3A in FIG. 3.
Figure 3B:
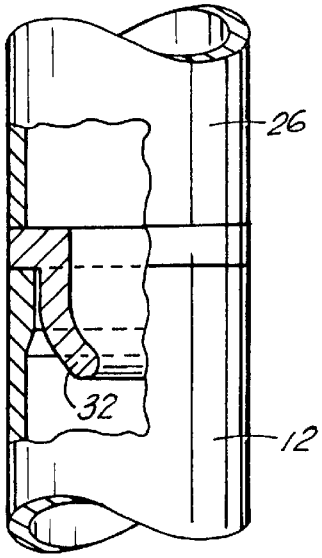
FIG. 3B PRIOR ART
FIG. 3B is a detail view of the interface between the slimline hammer and the pile top taken along lines 3B—3B in FIG. 3.

FIGS. 3, 3A, and 3B illustrate a prior art arrangement for a battered pile 12 driven by a slimline hammer 26 with pile 12 and hammer 26 guided by supports 28 extending out from the leg 30 of a jacket. It can be seen in FIG. 3B that the hammer 26 has an anvil 32 that stabs into the upper end of the pile 12.

Figure 4:
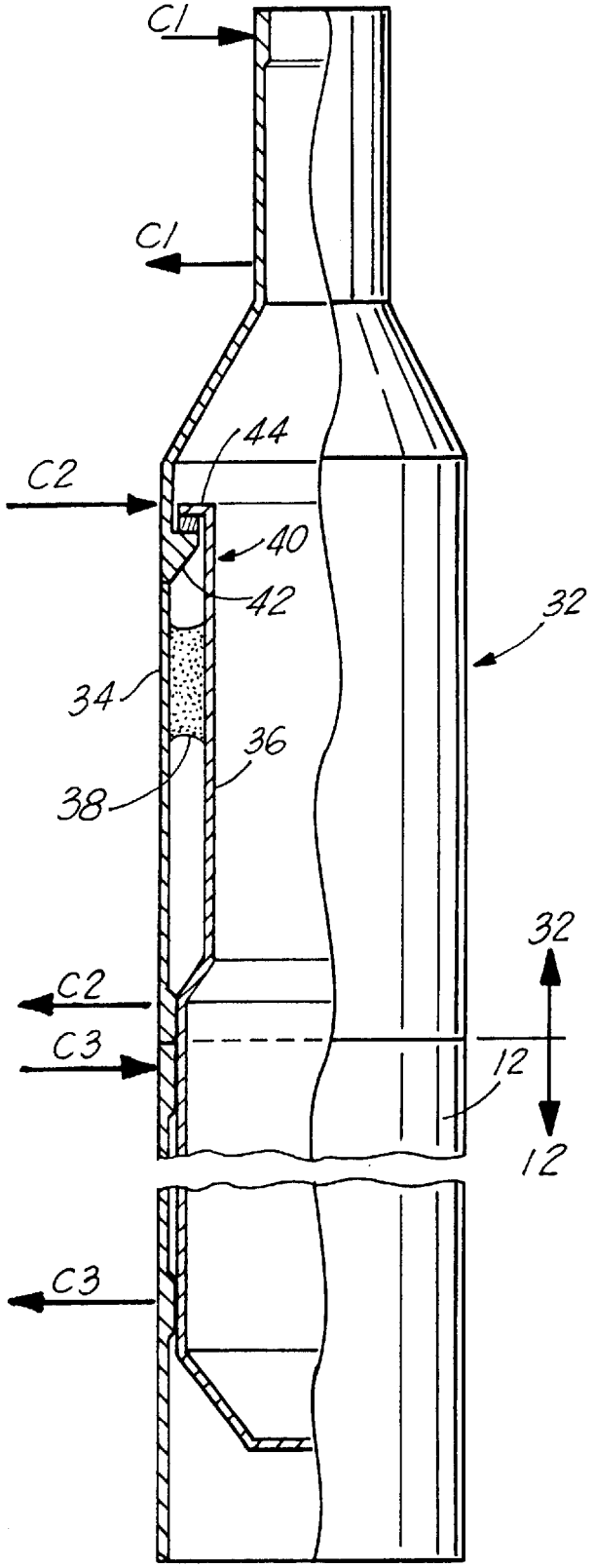
FIG. 4 illustrates the configuration of the invention for use with a free riding hammer.

It is seen in FIG. 4 that the invention is generally indicated by numeral 32. The shock avoiding pile driving transition piece 32 is generally comprised of a driving element 34, a cantilever element 36, and a shock isolation unit 38 between the driving and cantilever elements. This arrangement is for use with a free riding hammer, not shown. A free riding hammer is received over the top of the transition piece 32 during pile driving operations.

The cantilever element 36 is received in the upper end of the pile 12 and extends above the upper end of the pile 12. The shock isolation unit 38 provides the only axial connection between the driving element 34 and the cantilever element 36. The shock isolation unit 38 is formed from an elastomeric material, i.e. rubber vulcanized to the steel cylinders, or a material such as urethane bonded to the steel cylinders. The shock isolation unit material is resilient, so that when a blow is struck on top of the driving element, the driving energy passes through the driving element to the pile top without a significant portion of the energy being diverted into the cantilever element. In the prior art, the cantilever element is welded to the driving element, which results in a significant portion of the driving energy being diverted into the cantilever element, thus causing the running fatigue crack 24.

It is seen in FIG. 4 that Couple C1 cantilevers the free riding hammer 10 (not shown) from the transition piece 32. Couple C2 cantilevers the driving element 34 from the cantilever element 36. Couple C3 cantilevers the cantilever element 36 from the pile top. The couples are developed between close fitting cylindrical surfaces on the opposed elements, which permit relative axial motion of the elements when the hammer strikes a blow.

A fail-safe stop 40 may also be provided on the interior diameter of the driving element 34. The fail-safe stop 40 is formed from complimentary shoulders 42 and 44 on the driving element 34 and the cantilever element 36. The stop 40 prevents the cantilever element 36 from falling if the shock isolation unit 38 should fail completely during pile driving operations.

Figure 5:
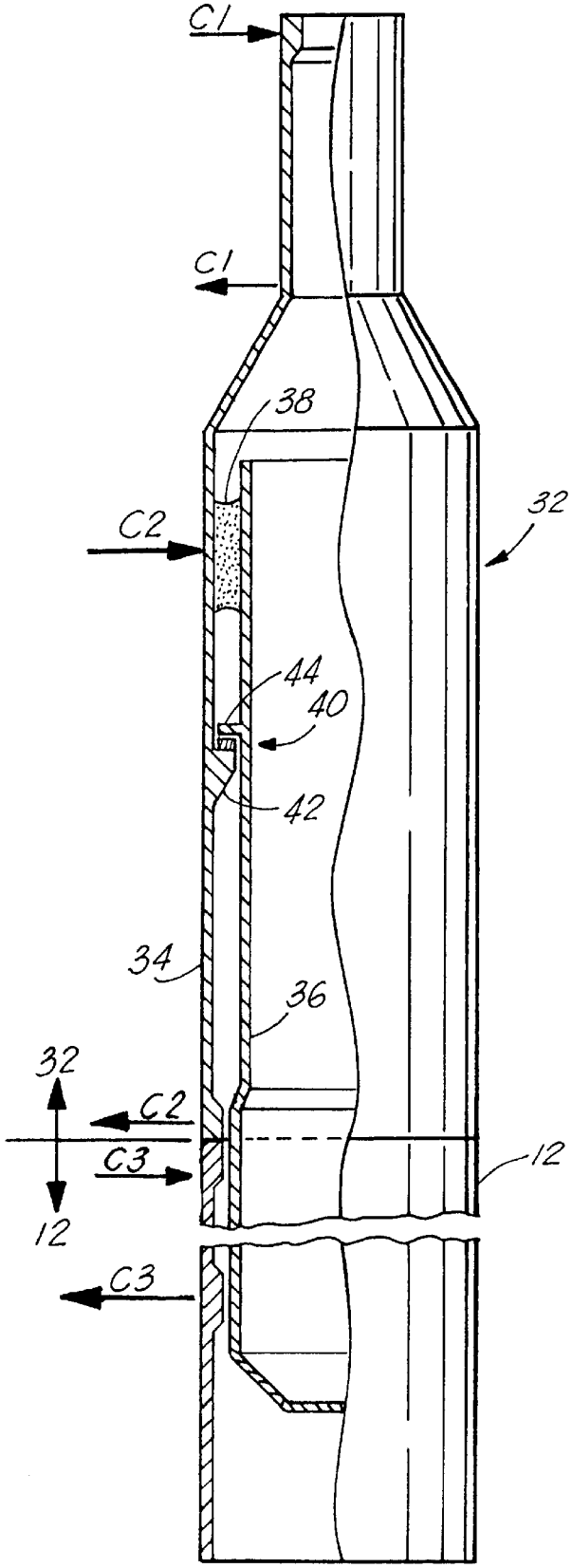
FIG. 5 illustrates an alternate embodiment of the invention in FIG. 4.

FIG. 5 illustrates an alternate embodiment of the invention of FIG. 4. In this embodiment, the shock isolation unit 38 is located on the top of the cantilever element 36. In this position, the shock isolation element 38 also serves to develop the upper force of Couple C2. This embodiment eliminates the required close tolerances of the cylindrical surfaces in this region. The fail-safe stop 40 is moved lower to accommodate the location of the shock isolation unit 38.

Figure 6:
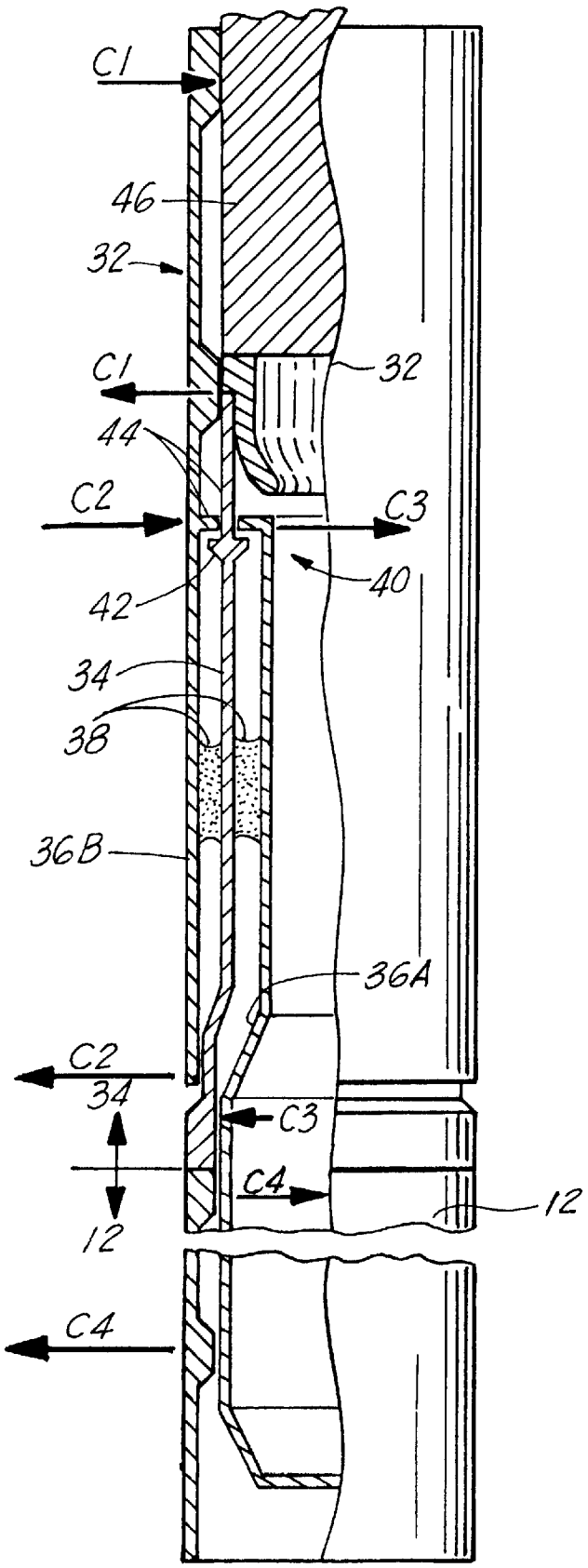
FIG. 6 illustrates the configuration of the invention for use with a slimline hammer.

FIG. 6 illustrates the shock avoiding pile driving transition piece 32 in an arrangement for use with a slimline hammer 46. In this arrangement, a first cantilever element 36*a* is received in the upper end of the pile 12 as in the arrangement of FIG. 4. A second cantilever element 36*b* extends above the pile 12 and is substantially the same diameter as the pile 12. The driving element 34 is positioned between the first and second cantilever elements and contacts the upper end of the pile for transferring driving force thereto. Two shock isolation units 38 are provided on either side of the driving element 34 to resiliently connect the driving element to the cantilever elements. The slimline hammer 46 is received in the second cantilever element 36*b* for contacting the driving element during pile driving operations. As indicated in the arrangement of FIG. 4, a fail-safe stop 40 may also be provided. Stop 40 is formed from shoulders 42 and 44 on the driving and cantilever elements, respectively. Couple C1 cantilevers the slimline hammer 46 from the second cantilever element 36*b*. Couple C2 cantilevers the second cantilever element 36*b* from the driving element 34. Couple C3 cantilevers the driving element 34 from the first cantilever element 36*a*. Couple C4 cantilevers the first cantilever element 36*a* from the pile 12.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A transition piece for use in driving a pile, comprising:

a. a cantilever element designed to receive a free riding hammer and sized to be received in the pile and extend above the pile;

b. a driving element for transferring driving force to a pile; and c. a shock isolation unit radially connecting said cantilever and driving elements.

2. The transition piece of claim 1, wherein said cantilever element is designed to receive a free riding hammer.

3. The transition piece of claim 1, wherein said shock isolation unit is formed from resilient material.

4. The transition piece of claim 1, further comprising a fail-safe stop between said cantilever element and said driving element.

5. A transition piece for use in driving a pile, comprising:

a. a first cantilever element designed to receive a driving hammer therein and sized to be received in the pile and extend above the pile;

b. a second cantilever element having substantially the same diameter as the pile;

c. a driving element for transferring driving force to a pile and being positioned between said first and second cantilever elements; and d. a shock isolation unit radially connecting said cantilever elements and said driving element.

6. The transition piece of claim 5, wherein said second cantilever element is designed to receive a driving hammer therein.

7. The transition piece of claim 5, wherein said shock isolation unit is formed from a resilient material.

8. The transition piece of claim 5, further comprising a fail-safe stop between said cantilever elements and said driving element.

* * * * *